United States Patent [19]

Barrett et al.

[11] Patent Number: 4,734,224

[45] Date of Patent: Mar. 29, 1988

[54] DRY NEUTRALIZATION PROCESS FOR DETERGENT SLURRIES

[75] Inventors: John H. Barrett, Phoenix; John O. Hudson, Scottsdale, both of Ariz.; Charles W. Lutz, Princeton, N.J.

[73] Assignee: The Dial Corporation, Phoenix, Ariz.

[21] Appl. No.: 907,945

[22] Filed: Sep. 15, 1986

[51] Int. Cl.[4] ..... C11D 11/04; C11D 1/22

[52] U.S. Cl. ..... 252/558; 252/539; 260/505 N

[58] Field of Search ..... 252/550, 551, 558, 554, 252/174.14, 555; 260/505 N

[56] References Cited

U.S. PATENT DOCUMENTS

| | | | |
|---|---|---|---|
| 2,594,690 | 4/1952 | Shiffler | 252/558 |
| 2,594,875 | 4/1952 | Condit | 252/558 |
| 2,671,797 | 3/1954 | Hagemann et al. | 260/505 N |
| 2,688,035 | 8/1954 | Jacob et al. | 260/505 N |
| 2,702,280 | 2/1955 | Mackinnon | 260/505 N |
| 2,766,276 | 10/1956 | Kolling | 260/505 N |
| 2,975,141 | 3/1961 | Blinoff et al. | 260/505 N X |
| 3,180,699 | 4/1965 | Ballestra | 260/505 N |
| 4,587,029 | 5/1986 | Brooks | 252/91 |

FOREIGN PATENT DOCUMENTS

| | | |
|---|---|---|
| 716521 | 10/1954 | United Kingdom . |
| 1404317 | 8/1975 | United Kingdom . |

*Primary Examiner*—Prince E. Willis

*Attorney, Agent, or Firm*—Frank T. Barber; Richard G. Harrer; Bernard L. Howard

[57] ABSTRACT

A high solids slurry of surfactant, inorganic builders and filler salts, which may be spray dried to produce a granular laundry detergent, is prepared by contacting mixed organic and inorganic acids, such as produced in the first stage of the oleum sulfonation of detergent alkylates, with a dry alkali metal carbonate and then with water while subjecting the ingredients and reaction mixture to a controlled mulling/smearing action.

10 Claims, No Drawings

DRY NEUTRALIZATION PROCESS FOR DETERGENT SLURRIES

FIELD OF INVENTION

The present invention pertains to the preparation of a precursor slurry for the production of spray dried built laundry detergents. In accordance with the invention, solid alkali metal carbonates, such as occur in soda ash, are used to neutralize the mixed organic and inorganic acids which result from the sulfonation of detergent alkylates. The neutralization reaction produces a high solids slurry of surfactant, inorganic builders and filler salts which may then be spray dried to produce a granular laundry detergent.

BACKGROUND AND PRIOR ART

When the oleum sulfonation process is used for the sulfonation of detergent alkylates, a substituted organic sulfonic acid is produced, together with large amounts of unreacted sulfuric acid which remain in the first stage reaction mixture. Since sodium sulfate is a commonly used inorganic filler in spray dried detergents, it would be desirable to neutralize such reaction mixture to produce a mixture of sodium alkylate sulfonate and sodium sulfate for use in the producing the spray dried detergents. However, neutralization of the mixed acids as they come from the first stage of the oleum sulfonation process involves difficult problems. If sodium hydroxide solution is used, the intensely exothermic reaction with the sulfuric acid causes thermal decomposition of the labile organic sulfonate in the presence of unreacted sulfuric acid and results in an unacceptably dark product. If alkali carbonate solutions are used for the neutralization, there is generation of copious amounts of carbon dioxide gas, producing unmanageable quantities of foam. Problems such as these are referred to in U.S. Pat. No. 2,594,875 to Condit and 3,425,948, to Otrbalek et al. and in U.K. Pat. No. 1,369,269.

In view of the above, the current procedure for oleum sulfonation and subsequent neutralization consists of a milder process which is conducted in three stages, as follows: In the first stage, oleum sulfonation is carried out to produce the mixed organic sulfonic acid and large quantities of unreacted sulfuric acid, as referred to above. In the second stage, water is added and, after removal of the heat of dilution, the mixture separates by gravity into a lighter organic sulfonic acid layer containing about 5 to 10% sulfuric acid and a heavy phase of about 80% sulfuric acid, commonly referred to as "spent acid". The spent acid is discarded. In the third stage, the organic sulfonic acid/sulfuric acid phase is reacted with dilute sodium hydroxide to form a slurry of from 40 to 60% sodium alkylate sulfonate, with 5 to 10% of sodium sulfate. The resulting slurry is commonly mixed with inorganic builder salts, inorganic fillers, antiredeposition agents, fluorescent whitening agents, sodium silicates, etc. to form a slurry which is then spray dried to a granular laundry detergent.

In the above current procedure, the elimination of the spent acid, together with the use of diluted sodium hydroxide, produces a milder, more readily manageable reaction. However, the discarding of the spent acid not only constitutes a waste of materials, but it has become a disposal problem since it is considered hazardous. Further, the use of water in the second stage and the water-dilution of the sodium hydroxide in the third stage introduce excess water which is costly to remove when the resulting slurry is subsequently spray dried.

Numerous U.S. patents have dealt with the problem of neutralizing various sulfonic acids with alkaline carbonates or other agents. Examples of such patents are r U.S. Pat. Nos. 2,594,690 to Shiffler; 2,975,141 to Blinoff et al; 2,982,736 to Dvorkovitz et al; 3,180,699 to Ballestra; 3,472,784 to Poe; 3,726,813 to Borrello; 3,772,204 to Insignares and 3,867,316 to Frank et al. However, none of the prior art patents provide a process of utilizing the mixed acids as they come from the first stage of the oleum sulfonation process, to produce a high solids, pumpable slurry suitable for subsequent spray drying.

It is an object of the present invention to provide such a process, in which the first stage mixture of organic and inorganic acids from the oleum sulfonation process are directly neutralized to produce a high solids slurry suitable for use in the production of spray dried laundry detergents.

It is another object of the invention to enhance oleum sulfonation plant capacity by eliminating certain exothermic stages from the process.

It is a further object to produce useful detergent ingredients from the spent acids which are currently discarded, while at the same time eliminating the substantial hazardous waste costs involved in disposing of the spent acids.

A further object is to reduce the amount of water added to the spray drying process stream.

A still further object is to provide for the use of a less costly neutralizing agent.

Other objects and advantages will be apparent from the following description and examples

SUMMARY OF THE INVENTION

This invention relates to a process for the neutralization of mixed organic and inorganic acids comprising the steps of contacting said acids with a dry alkali metal carbonate, subjecting the resulting mixture to a controlled mulling/smearing mechanical action, and subsequently adding water to said mixture while continuing the said mechanical action to produce a water-dispersible reaction product which is substantially completely neutralized. A preferred embodiment of the invention is a process for the neutralization of mixed organic and inorganic acids resulting from the oleum sulfonation of detergent alkylates, comprising the steps of contacting said acids with soda ash in a ratio of at least 0.9 parts soda ash to 1 part acid, by weight, subjecting the resulting mixture to a controlled mulling/smearing mechanical action, and subsequently adding water, in a ratio of from 0.6–1.5 to 1 parts by weight of the acids, while continuing said mechanical action to complete the neutralization before the temperature of the reaction mixture reaches 210° F., to produce a water-dispersible reaction product in which the said acids are substantially completely neutralized.

DETAILED DESCRIPTION OF THE INVENTION

Although the invention is applicable to the neutralization of mixed organic and inorganic acids in general, the preferred application of the invention involves neutralizing the mixed acids resulting from the first stage of the oleum sulfonation of detergent alkylates, and the invention will be described in terms of such process.

In the oleum sulfonation procedure, alkyl benzene is reacted with oleum to produce a first stage reaction product comprising a mixture of substituted organic sulfonic acids (such as tridecylbenzene sulfonic acid) with high concentrations of unreacted sulfuric acid. While the conventional procedures for neutralizing acids cannot be applied to this reaction mixture, as previously described, the present invention involves the discovery that it is in fact possible to neutralize the mixed acids at this stage by addition of dry alkali metal carbonate and water, in a specific sequence of steps, and under controlled mechanical conditions, as well as controlled conditions relating to the concentrations of alkali metal carbonates and added water.

The invention is effective in producing a substantially completely neutralized product, which is characterized by a white color, is free of organic acid fumes (e.g., similar to those of $SO_2$), exhibits little or no post reaction, and is readily dispersible in water or aqueous slurries. The reaction product temperature is greater than 140° F., indicating that neutralization (not just soda ash hydration) has occurred.

In the first step of the process of the present invention, the mixture of substituted organic sulfonic acids and unreacted sulfuric acid is contacted with a dry solid alkali metal carbonate. The nominal composition of a typical mixture of such acids is about 62% tridecylbenzene sulfonic acid and about 38% sulfuric acid. It is possible, if desired, to adjust the sulfuric acid content upwardly by adding additional sulfuric acid, such as the industrial "spent acid" previously described, and it is also possible to make a downward adjustment by allowing the sulfuric acid to settle out of the mixture. In the examples included in this specification, starting acid mixtures having sulfuric acid concentrations as high as 43% and as low as 30% have been used. The invention is not limited to this range of concentrations for the starting material, but the advantages of the invention are reduced as the concentrations become higher or lower.

The dry solid alkali metal carbonate which is added to the mixed organic and inorganic acids is preferably soda ash, which is an industrial product made by calcining various precursors ($NaHCO_3$, $Na_2CO_3$. $NaHCO_3.2H_2O$, $Na_2CO_3.H_2O$, etc.) to form sodium carbonate. It is a feature of the invention that substantially greater effects are produced if the soda ash used in the process is of the grade produced by the so-called "sesqui" process, in which soda ash in the form of a pseudomorph of sodium sesquicarbonate is produced, by calcining sodium sesquicarbonate. Examples of the preferred grades of soda ash are Grades 100, 120 and 160, supplied by FMC Corporation, of Philadelphia, Pa. The so-called "mono" grades of soda ash, produced by calcining sodium carbonate monohydrate (e.g., FMC Grade 260) are substantially less effective and can be made to work in the invention only by very careful control and exacting attention to critical reaction variables.

The weight ratio of alkali metal carbonate to mixed acids is important for successful operation of the invention. It has been found that soda ash must be used in amounts well in excess of the stoichiometric requirements for neutralization of the mixed acids. The weight ratio of soda ash to mixed acids must be at least about 0.9 to 1. If the amount of soda ash is reduced below this, the process output becomes more fluid, with longer post-reaction time and resulting darkness of the product due to incomplete neutralization. There is no upper limit on the soda ash concentration, except for practical batching problems and less flexibility in producing a variety of products. The preferred weight ratio of soda ash to mixed acids is in the range of 1.1–1.7 to 1.

After the mixed organic and inorganic acids are contacted with the dry solid alkali metal carbonate, as described above, the next step in the practice of the present invention is the addition of water. It is a critical feature of the invention that this specific sequence of steps be observed and that an opportunity is provided to insure dispersion of the mixed acids on the soda ash prior to the addition of water. If the process configuration allows prehydration of the soda ash before neutralization, unacceptable product results.

The amount of added water is important for successful operation of the process. It has been found that the added water must be well in excess of catalytic amounts and that the water must in fact be a reactant. More specifically, it has been found that the weight ratio of added water to mixed acids must be within the range of 0.6–1.5 to 1. Use of water in amounts below the lower limit of said range results in a dark, partially unneutralized output with a thick, mealy consistency. Use of water in excess of the upper range also yields a dark product, but with a very loose, runny consistency. Within the above range, other factors influence the amount of water which should be used in the process. Increasing the sulfuric acid content of the mixed organic and inorganic acids increases the minimum ratio of water to mixed acids required. Increasing the ratio of soda ash to mixed acid increases the maximum ratio of water to mixed acid that can be tolerated. Under normal conditions, the preferred ratio of water to mixed acids is within the range of 0.8–1.2 to 1.

It is an important feature of the invention that the contacting of the mixed organic and inorganic acids with the alkali metal carbonate, followed by addition of water, be carried out under controlled mechanical conditions. It is necessary that the equipment used for mixing the neutralization reactants be capable of mulling/smearing the soda ash reactant in situ, thus providing a greater surface area for reaction with the acid and water droplets which are atomized in the process. The mulling/smearing action should also be accompanied by a high intensity, vigorous mechanical action to insure that the neutralization reaction is initiated and maintained and proceeds to completion within a short period of time. Input of mechanical energy over too long a period of time imparts a "plastic" state to the end product, rendering it difficult to disperse. It is a feature of the invention that the reaction be completed typically in a period of less than 1 minute. In the preferred embodiment, residence time in the reactor equipment is in the range of 2 to 20 seconds. It is also preferable to use mixing equipment which is capable of confining the $CO_2$ and water vapor produced during the reaction. Confinement of the liberated product gases is beneficial in maintaining the reaction and driving it through to completion before excess mechanical energy is imparted. Finally, it is preferred that the equipment be capable of providing the mulling/smearing action, together with the high intensity mechanical action, to drive the exothermic reaction through to completion within the short period of time referred to above without the necessity of cooling means to avoid higher destructive temperatures in the reaction zone. The reaction should proceed at a temperature at least as high as 150° F. but should be completed before reaching 210° F.

A continuous processor capable of providing the above defined mechanical conditions is the Bepex Turbulizer, manufactured by Bepex Corporation, of Minneapolis, Minn. The processor is equipped with a series of rotating paddles which are adjustable to provide desired clearance between the ends of the paddles and the inner wall of the processor housing and operates with the desired short residence time (i.e., 2–20 seconds). The equipment allows sequential addition of the reactants; mulling/smearing action to pulverize the soda ash in situ while atomizing the acids and water; intense mechanical action from the paddles to drive the reaction to completion within the requisite time limits; and confinement of the liberated product gases. In reactions which have been run in the Bepex Turbulizer in accordance with the present invention, the equipment has been operated at 1800 RPM, with a sheer clearance of approximately ⅛ inch between the ends of the paddles and the inner wall of the housing, and without any cooling water in the jacket. These parameters are by way of example only and obviously can be varied to meet differing conditions with respect to the types and concentrations of reactants.

Another processor suitable for use in the practice of the invention is the Readco Continuous Processor, manufactured by Teledyne Readco, of York, Pa. Also, the Hobart Mixer, equipped with a dough blade, has been successfully used in the laboratory.

When the process of the present invention is carried out in accordance with the foregoing, the resulting product is a water dispersible reaction product which is substantially completely neutralized and comprises a high solids slurry suitable for mixing with conventional detergent builders and fillers and spray drying to produce a highly desirable laundry detergent. The practice of the present invention thus provides the following advantages:

1. The high hazardous waste disposal costs with respect to the "spent acids" are eliminated.
2. The "spent acids" are transformed into a valuable ingredient.
3. Oleum sulfonation plant capacity is increased, since two exothermic stages of the oleum sulfonation process are eliminated.
4. The amount of water added to the spray drying process stream is substantially reduced, thus providing lower energy costs.
5. The use of a lower cost alkaline neutralizing agent is enabled.

The following examples describe specific embodiments which are illustrative of the invention:

EXAMPLE 1

Mixed organic and inorganic acids, resulting from the first stage of the oleum sulfonation of detergent alkylates, were contacted with FMC Grade 160 soda ash, and subsequently with reaction water, in a Teledyne Continuous Processor. The mixed acids had a sulfuric acid content of approximately 38%. The weight ratios of soda ash, mixed acids and water were as set out in the table which follows. In the Teledyne Continuous Processor, the dry soda ash is introduced, and the ports for introducing liquids are numbered, starting with the port closest to the point of soda ash addition being designated #1, to which the mixed acids were introduced. The reaction water was introduced at port #1.5. The results of varying the water addition time and ratios are set forth in the table which follows:

| Prod # | Wt Ratios (Total) Soda Ash/Acid/Water | Water Levels & Location Reaction | Dilution (port #) | Prod. Temp. | Remarks |
|---|---|---|---|---|---|
| 1 | 1.25/1/0.06 | 0.06 | 0 | — | Incomplete Reaction |
| 2 | 1.5/1/0.06 | 0.06 | 0 | — | Complete reaction, plastic product, difficult to disperse |
| 3 | 1.5/1/0.12 | 0.12 | 0 | — | Product more dispersible, but not satisfactory |
| 4 | 1.5/1/1.1 | 0.12 | 0.99 (#4) | 160 | Product completely reacted Dispersible |
| 5 | 1.5/1/0.85 | 0.12 | 0.73 (#4) | 180 | Product completely reacted Dispersible |
| 6 | 1.5/1/0.65 | 0.12 | 0.53 (#4) | 200 | Mealy product, poorer dispersibility |
| 7 | 1.5/1/0.65 | 0.12 | 0.53 (#2) | — | Complete reaction, good dispersibility |
| 8 | 1.5/1/0.65 | 0.65 | 0 | — | Complete reaction, good dispersibility |

EXAMPLE 2

Pilot plant trials of this process employed a Bepex Turbulizer with a 14" diameter and involved the neutralization of what is industrially termed "mixed acid", the initial product from reacting alkyl benzene with oleum. The nominal composition of the "mixed acid" used for these trials was 61% tridecylbenzene sulfonic acid and 38% sulfuric acid. The sulfuric acid content was increased when desired with the addition of the industrial by-product "spent acid", which is typically 80% sulfuric acid and 20% water. The concentration of sulfuric acid was adjusted downwards by allowing it to partially settle out of the mixed acid. The effects of varying the soda ash and water ratios and the sulfuric acid content are set forth in the table which follows:

| % $H_2SO_4$ in Mixed Acid | Wt. Ratios Soda Ash/Acid/Water | Product Quality |
|---|---|---|
| 30 | 0.90/1/0.76 | Acceptable |
| 30 | 1.08/1/0.74 | Acceptable |
| 30 | 2.28/1/0.82 | Acceptable |
| 30 | 0.73/1/0.82 | Unacceptable |
| 38 | 1.78/1/1.18 | Acceptable |
| 38 | 0.86/1/0.95 | Unacceptable |
| 43 | 0.97/1/0.93 | Acceptable |
| 43 | 1.58/1/0.93 | Acceptable |
| 43 | 0.87/1/1.18 | Unacceptable |

EXAMPLE 3

The following example shows the effect of using different grades of soda ash in the process of the invention. In this example, mixed organic and inorganic acids from the first stage of the oleum sulfonation process were treated with soda ash and then with water in a Teledyne Readco Continuous Processor. The weight ratios of reactants were 1.5 soda ash/1 acid/0.65 water. The results were as follows:

| | % Na DDBS (Solid Basis) | Product Quality |
|---|---|---|
| Soda Ash from Sesqui Process | | |
| FMC G100 | 28.6 | White, completely reacted |
| FMC G160 | 27.7 | White, completely reacted |
| Soda Ash from Mono Process | | |
| FMC G260 | 26.8 | Poor product, incomplete reaction, acrid acid odor, profuse bubbling when dispersed in water |

Although various preferred embodiments of the invention have been described herein in detail it will be understood by those skilled in the art that variations may be made thereto without departing from the spirit of the invention.

What is claimed is:

1. A process for the neutralization of mixed organic and inorganic acids resulting from the sulfonation of detergent alkylates comprising the steps of contacting said acids with a dry alkali metal carbonate, the weight ratio of carbonate to acids being at least 0.9 to 1, subjecting the resulting mixture to a mulling/smearing mechanical action, and subsequently adding water to said mixture, the weight ratio of water to acids being from 0.6–1.5 to 1, while continuing the said mechanical action to produce a water-dispersible reaction product which is substantially completely neutralized.

2. The process of claim 1 in which the sulfonation is oleum sulfonation.

3. The process of claim 1 in which the alkali metal carbonate is soda ash.

4. The process of claim 3 in which the dry soda ash is a pseudomorph of sodium sesquicarbonate.

5. The process of claim 1 in which the temperature of the reaction mixture is maintained within the range of 140°–210° F.

6. The process of claim 1 in which the weight ratio of carbonate to mixed acids is in the range of 1.1–1.7 to 1.

7. The process of claim 1 in which the weight ratio of added water to mixed acids is in the range of 0.7–1.4 to 1.

8. A process for the neutralization of mixed organic and inorganic acids resulting from the oleum sulfonation of detergent alkylates comprising the steps of contacting said acids with soda ash, the weight ratio of soda ash to acids being at least 0.9 to 1, subjecting the resulting mixture to a mulling/smearing mechanical action, and subsequently adding water, the weight ratio of water to acids being from 0.6–1.5 to 1, while continuing the said mechanical action to complete the neutralization, to produce a water-dispersible reaction product in which the said acids are substantially completely neutralized.

9. A process for the neutralization of mixed organic and inorganic acids resulting from the oleum sulfonation of detergent alkylates comprising the steps of contacting said acids with soda ash, the weight ratio of soda ash to acids being about 1.1–1.5 to 1, subjecting the resulting mixture to a mulling/smearing mechanical action, and subsequently adding water, the weight ratio of water to acids being 0.65–1.1 to 1, while continuing the said mechanical action to complete the neutralization before the temperature of the reaction mixture reaches 210° F., to produce a water-dispersible reaction product in which the said acids are substantially completely neutralized.

10. A process for the production of a laundry detergent comprising the steps of contacting mixed organic and inorganic acids resulting from the oleum sulfonation of detergent alkylates with dry soda ash, the weight ratio of carbonate to acids being at least 0.9 to 1, subjecting the resulting mixture to a mulling/smearing mechanical action, subsequently adding water, the weight ratio of water to acid being from 0.6–1.5 to 1, continuing the said mechanical action to complete the neutralization before the temperature of the reaction mixture reaches 210° F., to produce a slurry in which said acids are substantially completely neutralized, mixing said slurry with conventional detergent builders and fillers, and spray drying the resulting slurry to produce a laundry detergent.

* * * * *